US006708531B1

(12) United States Patent
Thanikaivelan et al.

(10) Patent No.: US 6,708,531 B1
(45) Date of Patent: Mar. 23, 2004

(54) ECOFRIENDLY BIO-PROCESS FOR LEATHER PROCESSING

(75) Inventors: Palanisamy Thanikaivelan, Chennai (IN); Jonnalagadda Raghava Rao, Chennai (IN); Balachandran Unni Nair, Chennai (IN); Thirumalachari Ramasami, Chennai (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/300,409

(22) Filed: Nov. 19, 2002

(30) Foreign Application Priority Data

Oct. 30, 2002 (IN) ..... 1085/DEL/2002

(51) Int. Cl.[7] ..... C14B 1/00

(52) U.S. Cl. ..... 69/21; 69/22; 69/24; 8/94.1 R

(58) Field of Search ..... 69/21, 22, 23, 69/24, 28; 8/94.1 R, 94.14, 94.15, 94.17, 94.18, 94.2; 252/8.57, 188.2; 435/265, 262, 221, 68.1, 263

(56) References Cited

U.S. PATENT DOCUMENTS

| | | | | | |
|---|---|---|---|---|---|
| 3,254,938 | A | * | 6/1966 | Rodriguez et al. | 8/94.27 |
| 3,986,926 | A | * | 10/1976 | Monsheimer et al. | 435/265 |
| 4,294,087 | A | * | 10/1981 | Monsheimer et al. | 69/21 |
| 4,333,731 | A | * | 6/1982 | Schindlmayr et al. | 8/436 |
| 4,484,924 | A | * | 11/1984 | Pfleiderer et al. | 8/94.17 |
| 4,960,428 | A | * | 10/1990 | Christner et al. | 8/94.18 |
| 5,834,299 | A | * | 11/1998 | Andersen | 435/265 |
| 5,885,302 | A | * | 3/1999 | Leuck | 8/94.19 R |
| 5,900,027 | A | * | 5/1999 | Geihsler et al. | 8/94.19 R |

* cited by examiner

*Primary Examiner*—Gary L. Welch
(74) *Attorney, Agent, or Firm*—Merchant & Gould P.C.

(57) ABSTRACT

The present invention relates to an eco-friendly beam house process for de-hairing of leather using commercially available enzymes that obviates the use of lime and other alkalis. The present invention also provides an alternate process for opening the fibers of leather using commercially available enzymes. The present invention further provides a three-step process for tanning hide or skin in a narrow pH range of from about 7.5 to about 8.5.

23 Claims, No Drawings

ECOFRIENDLY BIO-PROCESS FOR LEATHER PROCESSING

FIELD OF THE INVENTION

The present invention relates to a novel eco-friendly bio-process for leather processing. More particularly, the present invention provides an eco-friendly beam house process for de-hairing of leather using commercially available enzymes that obviates the use of lime and other alkalis. The present invention also provides an alternate process for opening the fibres of leather using commercially available enzymes. The present invention further provides a three-step process for tanning hide or skin in a narrow pH range of from about 7.5 to about 8.5.

BACKGROUND AND PRIOR ART REFERENCES

Conventional leather processing involves a number of unit processes and operations namely soaking, liming (dehairing), reliming (fibre opening), deliming, pickling, chrome/vegetable tanning, rechroming, neutralisation, retanning, dyeing and fatliquoring. Liming-reliming processes are the inevitable steps in leather processing. The main objectives of liming are the removal of hair, flesh and splitting of fibre bundles by chemical and physical means. To achieve these, lime and sodium sulphide are employed along with substantial quantity of water. Various application methods include pit, paddle, drum and painting on flesh side. Generally, liming-reliming process liquors contribute to 50–70% of the total biochemical oxygen demand (BOD) and chemical oxygen demand (COD) load from a tannery wastewater and 15–20% in the case of total solids (TS) load as reported by Aloy et al (Tannery and Pollution, Centre Technique Du Cuir: Lyon, France, 1976). Apart from this, a great deal of solid wastes containing lime sludge, fleshings, and hair are generated. The extensive use of sulphide bears unfavorable consequences on environment and the efficacy of effluent treatment plants as reported by Colleran et al (Antonie van Leeuwenhoek, 67, 29, 1995).

Several lime and sulphide free liming methods have evolved during the past century. Bose and Dhar (Leather Science, 2, 140, 1955; 21, 39, 1974) have reviewed the use of enzymes such as proteolytic, amylolytic, etc from various sources namely animal, mold, bacterial and plant for dehairing hides and skins. However, these methods include the use of lime. Rosenbusch (Das Leder, 16, 237, 1965) has reported the use of chlorine dioxide for dehairing. Morera et al (Journal of the Society of Leather Technologists and Chemists, 81, 70, 1997) have studied the use of hydrogen peroxide in alkaline medium for dehairing by oxidation mechanism. However, the reduction in pollution load especially COD is not significant. Sehgal et al (Journal of the Society of Leather Technologists and Chemists, 80, 91, 1996) have developed a non-enzymatic sulphide free dehairing process using 1% nickel carbonate, 1% sodium hydroxide, 5% lime and kaolin along with water by painting. However, disposal or recovery of nickel compounds poses serious health problems. Schlosser et al (Journal of the Society of Leather Technologists and Chemists, 70, 163, 1986) have reported the use of lacto-bacillus based enzymes at acidic conditions for dehairing. This method leads to the solubilisation of collagen at the experimental conditions. Valeika et al (Journal of the Society of Leather Technologists and Chemists, 81, 65, 1997; 82, 95, 1998) have attempted to replace lime for dehairing using sodium hydroxide and sodium sulphide. They also found that the addition of salts such as sodium chloride, sodium sulphate, sodium formate or sodium hydrogen phosphate influence the extent of hair removal as well as opening up of the dermis structure. Commercial application of these methods is not popular in the global leather sector. However, enzyme-assisted lime-sulphide dehairing is being followed in some parts of the world. Nevertheless, only partial replacement of sulphide has been feasible in such kind of applications. All these methods are applicable for only dehairing of skins/hides in leather processing. The dehaired pelts require fibre opening. Conventionally the fibre opening is obtained by treatment with lime through osmotic swelling. Monshemier et al (U.S. Pat. No. 4,294,087, 1981) have developed a process for dehairing using a mixture of alkali and enzyme at a pH range of 11–13, where hair is recovered and the opening up of fibre bundles is carried out through osmotic swelling. However, this process requires deliming as practised for conventional leather processing.

Liming removes all the interfibrous materials especially proteoglycans and produces a system of fibres and fibrils of collagen which are clean as described by Campbell et al (Journal of American Leather Chemists Association, 68, 96, 1973). This is achieved by the alkali action as well as osmotic pressure built up in the skin matrix. Hence, in principle, it is possible to produce pelt by removing the protein-carbohydrate conjugates through enzyme action. Steven (Biochimica Biophysica Acta, 97, 465, 1965) and Burton et al (Journal of the Society of Leather Technologists and Chemists, 37, 82, 1953) have shown that α-amylase has specific activity on carbohydrate containing proteins such as proteoglycans.

Conventional leather processing involves a number of unit processes and operations. It includes a combination of single and multi-step processes that employs as well as expels various biological, organic and inorganic materials as described by Germann (Science and Technology for Leather into the Next Millennium, Tata McGraw-Hill Publishing Company Ltd., New Delhi, 1999, p. 283). Conventional method of pre-tanning and tanning processes involve 7–8 steps comprising soaking, liming, reliming, deliming, bating, pickling, chrome tanning and basification and discharge enormous amount of pollutants. This accounts for nearly 90% of the total pollution from a tannery as analyzed by Aloy et al (Tannery and Pollution, Centre Technique Du Cuir, Lyon, France, 1976). This includes biochemical oxygen demand (BOD), chemical oxygen demand (COD), total dissolved solids (TDS), sulphides, chlorides, sulphates, chromium, etc. This is primarily due to the fact that the conventional leather processing employs 'do-undo' process schemes such as swell-deswell (liming-deliming); pickle-depickle (pickling-basification) as described by Bienkewicz (Physical Chemistry of Leather Making, Krieger Publishing, Malabar, Fla., 1983). In other words, conventional methods employed in, leather processing subject the skin/hide to wide variations in pH. Such pH changes demand the usage of acids and alkalis, which leads to the generation of salts. This results in a net increase in COD, TDS, chlorides, sulphates and other minerals in tannery wastewaters as reported by Thanikaivelan et al (Journal of the Society of Leather Technologists and Chemists, 84, 276, 2000). Further, toxic gases like ammonia and hydrogen sulphide are also emitted. Apart from this, a great deal of solid wastes like lime sludge from tannery and chrome sludge from effluent treatment plant are being generated. This happens to be a major stumbling block for many of the tanners around the world due to the stringent environmental regulations.

Attempts have been made to either reduce the pollution or replace the toxic chemicals by revamping the individual processing steps. Conventional liming-reliming process liquors contribute to 50–70% of the total biochemical oxygen demand (BOD) and chemical oxygen demand (COD) load from a tannery wastewater and 15–20% in the case of total solids (TS) load as reported by Aloy et al (Tannery and Pollution, Centre Technique Du Cuir, Lyon, France, 1976). Apart from this, a great deal of solid wastes containing lime sludge, fleshings, and hair are generated. The extensive use of sulphide bears unfavorable consequences on environment and the efficacy of effluent treatment plants as reported by Colleran et al (Antonie van Leeuwenhoek, 67, 29, 1995). Several lime and sulphide free liming methods have evolved during the past century. Bose and Dhar (Leather Science, 2, 140, 1955; 21, 39, 1974) have reviewed the use of enzymes such as proteolytic, amylolytic, etc from various sources namely animal, mold, bacterial and plant for dehairing hides and skins. However, these methods include the use of lime. Rosenbusch (Das Leder, 16, 237, 1965) has reported the use of chlorine dioxide for dehairing. Morera et al (Journal of the Society of Leather Technologists and Chemists, 81, 70, 1997) have studied the use of hydrogen peroxide in alkaline medium for dehairing by oxidation mechanism. However, the reduction in pollution load especially COD is not significant. Sehgal et al (Journal of the Society of Leather Technologists and Chemists, 80, 91, 1996) have developed a non-enzymatic sulphide free dehairing process using 1% nickel carbonate, 1% sodium hydroxide, 5% lime and kaolin along with water by painting. However, disposal or recovery of nickel compounds poses serious health problems. Schlosser et al (Journal of the Society of Leather Technologists and Chemists, 70, 163, 1986) have reported the use of lacto-bacillus based enzymes at acidic conditions for dehairing. This method leads to the solubilisation of collagen at the experimental conditions. Valeika et al (Journal of the Society of Leather Technologists and Chemists, 81, 65, 1997; 82, 95, 1998) have attempted to replace lime for dehairing using sodium hydroxide and sodium sulphide. They also found that the addition of salts such as sodium chloride, sodium sulphate, sodium formate or sodium hydrogen phosphate influence the extent of hair removal as well as opening up of the dermis structure. Most of these methods are operated at alkaline pH and hence need a deliming step.

In order to reduce nitrification of soil, some ammonia-free deliming methods have been developed. These include adding materials based on carbondioxide by Munz and Toifl (Das leder, 43, 41, 1992) and esters of carboxylic acids by Streicher (Leder u. Hautemarkt, 39, 7, 1987) with limited success. Conventional chrome tanning generally involves pickling, tanning using basic chromium sulphate (BCS) followed by basification processes. Spent pickle liquor has high dissolved solid content and a considerable amount of chemical oxygen demand, since pickling involves the use of 8–10% sodium chloride salt along with required quantity of sulfuric acid as reported by Aloy et al (Tannery and Pollution, Centre Technique Du Cuir, Lyon, France, 1976). The use of non-swelling acids in pickling has been reported by Herfeld and Schubert (Das leder, 26, 117, 1975) in order to reduce total dissolved solids. Several better chrome management methods based on high exhaust chrome tanning as reported by Chandrasekaran (Leather Science, 34, 91, 1987), pickle-less tanning as given by Venba et al (Poster presented at $30^{th}$ LERIG, Chennai, 1995), chrome recovery and reuse as reported by Covington et al (Journal of the Society of Leather Technologists and Chemists, 67, 5, 1983) and closed pickle-tan loop system as described by Rao et al (Science and technology for leather into the next millennium, Proceedings of the XXV IULTCS Congress, 1999, 295) have been developed. These improvements are specific to a unit operation. Implementation of all the advanced technologies involves financial input and machinery requirements as well. This calls for the evolution of integrated process technologies and revamping the process sequence.

Very few attempts have been made to revamp the whole leather processing steps. Thanikaivelan et al (Journal of the Society of Leather Technologists and Chemists 84, 276, 2000; 85, 106, 2001) have attempted to make leather in a narrower pH range from 4.0–8.0. They have successfully carried out the dehairing process at pH 8.0 without employing lime. However, the attempt to open up the fibre bundles using urea or bating enzyme was not very successful as the resultant leather did not match the properties of conventionally processed leather.

OBJECTS OF THE INVENTION

The main object of the present invention is to provide a novel tanning technique for processing leather which obviates the drawbacks stated above.

Another object of the present invention is to provide a novel bio-process for dehairing of hide/skin using commercially available enzymes that obviates the use of lime or alkalis.

Still another object of the present invention is to provide a convenient method that does not involve continuous lowering or increasing of pH.

Yet another objective of the present invention is to provide an alternate method for opening the fibres of skin or hide that reduces the use of lime.

One more object of the present invention is to provide an alternate tanning process that obviates the requirement of pickling and basification of hide or skin.

Another objective of the present invention is to provide a bio based beam-house process that leads to significant reduction in chemical oxygen demand and total solids load.

Yet another objective of the present invention is to provide a bio based beam-house process that totally obviates the formation of dry sludge.

Still another objective of the present invention is to provide a three-step process that provides leathers matching the properties of leathers from conventional leather processing steps.

SUMMARY OF THE INVENTION

Accordingly, the present invention provides a novel leather processing technique consisting the steps of:

(i) applying to raw skin or hide a dehairing paste consisting of one or more enzymes either individually or in combination with a de-hairing enhancing compound;

(ii) seasoning the skin or hide of step (i) for 8–20 hrs;

(iii) de-hairing the seasoned skin or hide of step (ii);

(iv) applying to the de-haired skin or hide of step (iii) one or more collagen fibre bundle opening enzymes or an alkali;

(v) fleshing and washing the skin or hide of step (iv) to obtain clean pelt having cross section pH of from about 7.5 to about 8.5, and (vi) tanning the pelt of step (v) followed by further processing to obtain tanned leather.

DETAILED DESCRIPTION OF THE INVENTION

Accordingly, the present invention provides a novel leather processing technique consisting the steps of:

(i) applying to raw skin or hide a dehairing paste consisting of one or more enzymes either individually or in combination with a de-hairing enhancing compound;

(ii) seasoning the skin or hide of step (i) for 8–20 hrs;

(iii) de-hairing the seasoned skin or hide of step (ii);

(iv) applying to the de-haired skin or hide of step (iii) one or more collagen fibre bundle opening enzymes or an alkali;

(v) fleshing and washing the skin or hide of step (iv) to obtain clean pelt having cross section pH of from about 7.5 to about 8.5, and (vi) tanning the pelt of step (v) followed by further processing to obtain tanned leather.

In an embodiment of the present invention, the raw skin or hide used is selected from wet-salted, dry-salted, dried, green or freezed skin or hide.

In another embodiment of the present invention, prior to the step of applying the de-hairing paste, the skin or hide is soaked in water and drained from about 10 to about 20 minutes.

In yet another embodiment of the present invention, the do-hairing paste consists of 10–20 wt. % of one or more enzymes, 0 to 15 wt. % of the de-hairing enhancing compounds and 70–90 wt. % of water.

In still another embodiment of the present invention, the de-hairing paste contains 0.5–2.0 wt. % of one or more enzymes on the soaked weight of skin or hide.

In one more embodiment of the present invention, the de-hairing paste contains 0–1.5 wt. % of the de-hairing enhancing compound on the soaked weight of skin or hide.

In one another embodiment of the present invention, the de-hairing paste contains 4–8 wt. % of water on the soaked weight of skin or hide.

In a further embodiment of the present invention, the enzyme is bacterial protease or fungal protease or combination thereof.

In an embodiment of the present invention, the de-hairing enzyme is selected from Biodart®, Microdep C® or a combination thereof.

In another embodiment of the present invention, the de-hairing enhancing compound is selected from sodium sulphide or sodium sulphydride.

In yet another embodiment of the present invention, the de-hairing paste is applied on flesh or grain side of the skin or hide.

In still another embodiment of the present invention, the collagen fibre bundle opening enzyme is selected from the group consisting of α-amylase, β-amylase, zymase, maltase, pectinase, elastase, hyaluronidase, α-galactosidase, or a combination thereof.

In one more embodiment of the present invention, the alkali used for opening fibre bundles is selected from the group consisting of sodium hydroxide, potassium hydroxide or a combination thereof.

In one another embodiment of the present invention, 0.5–2.0 wt. % of collagen fibre bundle opening enzyme is used on the dehaired weight of skin or hide.

In a further embodiment of the present invention, 0.3 to 1.25 wt. % of alkali is used on the dehaired weight of skin or hide.

In an embodiment of the present invention, 50 to 350 wt. % of water is used on the dehaired weight basis of skin or hide during collagen fibre bundle opening.

In another embodiment of the present invention, the collagen fibre bundle opening is carried out for 2 to 24 hours.

In yet another embodiment of the present invention, collagen fibre bundles of the skin or hide are opened by loading a drum with 50 to 350 wt. % water, 0.5 to 2.0 wt. % of the enzyme or 0.3 to 1.25 wt. % of the alkali and the hide or skin and running the drum from about 2 to about 24 hours.

In still another embodiment of the present invention, the pelt having cross section pH of 7.5 to 8.5 is optionally pickled before the step of tanning.

In one more embodiment of the present invention, 4 to 10 wt. % of the tanning agent is added to fleshed skin or hide.

In one another embodiment of the present invention, 50 to 150 wt. % of water is added to fleshed skin during tanning.

In a further embodiment of the present invention, the tanning period is from about 2 to about 10 hours.

In an embodiment of the present invention, the tanning agent is selected from polymeric syntan, basic chromium sulphate (BCS), chrome syntan, wattle extract, chromium-iron tanning agent, aluminium syntan, chromium-silica tanning, vegetable tanning agent or combination thereof.

In another embodiment of the present invention, the tanned leathers may be followed by conventional leather processing sequence to obtain leathers for different end use.

The process of the present invention is described below in detail.

The raw material, skins or hides, is soaked in water conventionally. The weight of the soaked skins or hides is noted after draining for 10–15 minutes. A dehairing enzyme or mixture of enzymes in the range of 0.5–2.0% on the weight of soaked skins or hides is mixed with a chemical that assists the enzyme in the range of 0–1.5% on the weight of soaked skins or hides in 4–8% water on the weight of soaked skins or hides to form a paste. The prepared paste is applied on the flesh or grain side of the soaked skins or hides and piled for 8–20 hrs. The skins or hides are then dehaired using a conventional procedure and the weight of the skin or hide is noted down. The dehaired skins or hides are mixed with 50–350% water on the weight of dehaired skins or hides conventionally. An enzyme or mixture of enzymes that capable of opening up of fibre bundles is added in the range of 0.5–2.0% on the weight of dehaired skins or hides. Alternatively an alkali in the range of 0.3–1.25% on the weight of dehaired skins or hides can be used for the same purpose. The duration of fibre opening treatment is in the range of 2–24 hrs. The opened up skins/hides are fleshed conventionally. The weight of the pelts (skin or hide without hair and flesh) is noted. The cross section pH of the pelts is found to be 7.5–8.0. The pelts are tanned using basic chromium sulphate, vegetable tannins, chrome syntan, aluminium syntan, chromium-iron tanning agent, chromium-silica tanning agent in the range of 4–10% on the fleshed weight of skins or hides either alone or in combination with polymeric syntan in the range of 0.5–2.5% on the fleshed weight of skins or hides or other tanning agents in 50–150% water on the fleshed weight of skins or hides. The duration of tanning is in the range of 2–10 hrs. The tanned leathers are then followed by conventional leather processing sequence for different end uses.

The novelty and non obviousness of the present development lies in using enzymes for dehairing that target hair as well as specific enzymes or alkali for fibre opening that target the cementing substances such as proteoglycans, which facilitates fibre opening. Also, it should be noted that all the aforesaid steps have been accomplished without pH adjustment. Thus this approach forms an eco-friendly bio-based beam house process that aims towards zero waste criteria and more particularly, eliminates the use of lime totally.

The invention is described in detail in the following examples, which are provided by way of illustration only and therefore should not be construed to limit the scope of the present invention.

EXAMPLE 1

Three wet salted goatskins, weighing 2.7 kg, were soaked conventionally. The soaked skins were drained to remove surface water and the weight was found to be 3 kg. 30 gms Biodart and 6 gms Microdep C were mixed in 120 ml water along with 6 gms sodium sulphydride to form a paste. The prepared paste was applied on the flesh side of the goatskins and piled flesh side of one skin to flesh side of the other and left undisturbed for 8 hrs. The skins were then dehaired conventionally. Weight of the dehaired skins was found to be 2.8 kg.

The dehaired goatskins were loaded in a drum with 2800 ml water. To this, 28 gms α-amylase was added and the drum was run for 4 hrs. The bath was drained off and the skins were scudded and fleshed conventionally. Weight of the pelts was found to be 3.2 kg. Cross section pH of the pelts was found to be 8.0.

EXAMPLE 2

The pelts obtained in Example 1 were washed with 5600 ml water for 10 minutes and drained. Then the pelts were pickled conventionally to a pH 2.8. This was followed by chrome tanning using conventional procedure. The chrome tanned leathers were post tanned to crust upper leathers using a standard recipe. Then the leathers were staked, trimmed and buffed.

EXAMPLE 3

The pelts obtained in Example 1 were washed with 5600 ml water for 10 minutes and drained. A mixture of 16 gms polymeric syntan (developed by Kanthimathi et al for which an Indian Patent has been applied) and 128 gms BCS was added to the drum along with 1600 ml water. The drum was run for 2 hrs. The penetration of the chromium was complete and the pH was found to be 4.5. The chrome tanned leathers were post tanned to crust upper leathers using a standard recipe. Then the leathers were staked, trimmed and buffed.

EXAMPLE 4

Three dry salted sheepskins, weighing 4.7 kg, were soaked conventionally. The soaked skins were drained to remove surface water and the weight was found to be 6 kg. 60 gms Biodart was mixed in 300 ml water along with 30 gms sodium sulpide to form a paste. The prepared paste was applied on the flesh side of the sheepskins and piled flesh side of one skin to flesh side of the other and left undisturbed for 10 hrs. The skins were then dehaired conventionally. Weight of the dehaired skins was found to be 4 kg.

The dehaired skins were loaded in a drum with 2000 ml water. To this, 15 gms α-amylase, 2 gms zymase and 3 gms pectinase were added and the drum was run for 6 hrs. The bath was drained off and the skins were scudded and fleshed conventionally. Weight of the pelts was found to be 3.5 kg. Cross section pH of the pelts was found to be 7.8.

EXAMPLE 5

The pelts obtained in Example 4 were washed with 7000 ml water for 10 minutes and drained. Then the pelts were partially pickled using conventional procedure to a pH 4.5. This was followed by vegetable tanning using standard procedure. The vegetable tanned leathers were post tanned to crust upper leathers using a standard recipe. Then the leathers were staked, trimmed and buffed.

EXAMPLE 6

The pelts obtained in Example 4 were washed with 7000 ml water for 10 minutes and drained. 180 gms BCS was added to the drum along with 1800 ml water. The drum was run for 3 hrs. The penetration of the chromium was complete and the pH was found to be 4.1. The chrome tanned leathers were post tanned to crust garment leathers using a standard recipe. Then the leathers were staked, trimmed and buffed.

EXAMPLE 7

Four green cow sides, weighing 23 kg, were soaked conventionally. The soaked sides were drained to remove surface water and the weight was found to be 24 kg. 120 gms Biodart was mixed in 1920 ml water along with 360 gms sodium sulphide to form a paste. The prepared paste was applied on the grain side of the cow sides and piled grain side of one side to grain side of the other and left undisturbed for 20 hrs. The sides were then dehaired conventionally. Weight of the dehaired sides was found to be 22 kg.

The dehaired sides were loaded in a drum with 33000 ml water. To this, 400 gms α-amylase, 20 gms α-galactosidase and 20 gms maltase were added and the drum was run for 2 hrs. The bath was drained off and the sides were scudded and fleshed conventionally. Weight of the pelts was found to be 26 kg. Cross section pH of the pelts was found to be 8.0.

EXAMPLE 8

The pelts obtained from Example 7 were washed with 52000 ml water for 10 minutes and drained. Then the pelts were pickled conventionally to a pH 2.8. This was followed by chrome tanning using conventional procedure. The chrome tanned leathers were post tanned to crust upper leathers using a standard recipe. Then the leathers were staked, trimmed and buffed.

EXAMPLE 9

The pelts obtained from Example 7 were washed with 52000 ml water for 10 minutes and drained. 2.6 kg chrome syntan (developed by Kanthimathi et al for which an Indian Patent Application has been filed) was added to the drum along with 20800 ml water. The drum was run for 10 hrs. The penetration of the chromium was complete and the pH was found to be 4.2. The chrome tanned leathers were post tanned to crust upholstery leathers using a standard recipe followed for chrome syntan tanned leathers as reported by Suresh et al (Journal of Cleaner Production, 9, 483, 2001). Then the leathers were staked, trimmed and buffed.

EXAMPLE 10

Three dried buffcalfs, weighing 17 kg, were soaked conventionally along with wetting agents. The soaked calfs were drained to remove surface water and the weight was found to be 22 kg. 330 gms Biodart and 110 gms Microdep C were mixed in 1320 ml water to form a paste. The prepared paste was applied on the grain side of the calfs and piled grain side of one calf to grain side of the other and left undisturbed for 18 hrs. The calfskins were dehaired conventionally. Weight of the dehaired calfs was found to be 20 kg.

The dehaired calfs were loaded in a drum with 20000 ml water. To this, 200 gms α-amylase, 50 gms hyaluronidase and 50 gms β-amylase were added and the drum was run for 3 hrs. The bath was drained off and the calfskins were scudded and fleshed conventionally. Weight of the pelts was found to be 24 kg. Cross section pH of the pelts was found to be 7.5.

EXAMPLE 11

The pelts obtained from Example 10 were washed with 48000 ml water for 10 minutes and drained. Then the pelts were pickled conventionally to a pH 2.8. This was followed by chrome tanning using conventional procedure. The chrome tanned leathers were post tanned to crust garment leathers using a standard recipe. Then the leathers were staked, trimmed and buffed.

EXAMPLE 12

The pelts obtained from Example 10 were washed with 48000 ml water for 10 minutes and drained. 2.4 kg wattle extract was added to the drum along with 24000 ml water. The drum was run for 8 hrs. Penetration was complete. Tanned leathers were post tanned to crust aniline upper leathers using a standard recipe. Then the leathers were staked, trimmed, buffed and finished conventionally.

EXAMPLE 13

The pelts obtained from Example 10 were washed with 48000 ml water for 10 minutes and drained. 1.2 kg chromium-silica tanning agent as developed by Thanikaivelan et al (Indian Patent, CSIR Ref. No. NF240/2000, 2000) and 0.7 kg aluminium syntan were added to the drum along with 24000 ml water. The drum was run for 6 hrs. Tanning was complete and the pH was found to be 4.4. Tanned leathers were post tanned to crust garment leathers using a standard recipe. Then the leathers were staked, trimmed and buffed.

EXAMPLE 14

Three dry salted sheepskins, weighing 4.8 kg, were soaked conventionally. The soaked skins were drained to remove surface water and the weight was found to be 6 kg. 60 gms Biodart was mixed in 300 ml water along with 30 gms sodium sulpide to form a paste. The prepared paste was applied on the flesh side of the sheepskins and piled flesh side of one skin to flesh side of the other and left overnight. Next day, the skins were dehaired conventionally. Weight of the dehaired skins was found to be 4 kg.

The dehaired skins were loaded in a drum with 14000 ml water. To this, 12 gms sodium hydroxide was added and the drum was run for 30 minutes and left undisturbed for 30 minutes. This was followed by 5 minutes running for each hour for 6 hrs and then left undisturbed for 12 hrs. Next day, the bath was drained off and the skins were fleshed conventionally. Weight of the pelts was found to be 3.6 kg. Cross section pH of the pelts was found to be 8.2.

The pelts were washed with 7000 ml water for 10 minutes and drained. 180 gms chromium-iron tanning agent developed by Rao et al (Indian Patent, 446DEL99, 1999) was added to the drum along with 36000 ml water. The drum was run for 3 hrs. Penetration was complete and the pH was found to be 4.4. Tanned leathers were post tanned to crust garment leathers using a standard recipe. Then the leathers were staked, trimmed and buffed.

EXAMPLE 15

Four green cow sides, weighing 24 kg, were soaked conventionally. The soaked sides were drained to remove surface water and the weight was found to be 25 kg. 120 gms Biodart was mixed in 1920 ml water along with 360 gms sodium sulphide to form a paste. The prepared paste was applied on the grain side of the cow sides and piled grain side of one side to grain side of the other and left overnight. Next day, the sides were dehaired conventionally. Weight of the dehaired sides was found to be 22 kg.

The dehaired sides were loaded in a drum with 77000 ml water. To this, a mixture of 220 gms sodium hydroxide and 55 gms potassium hydroxide was added and the drum was run for 30 minutes and left undisturbed for 30 minutes. This was followed by 5 minutes running for each hour for 6 hrs and then left undisturbed for 12 hrs. Next day, the bath was drained off and the sides were fleshed using conventional procedure. Weight of the pelts was found to be 26 kg. Cross section pH of the pelts was found to be 8.5.

The pelts were washed with 52000 ml water for 10 minutes and drained. 2.34 kg aluminium syntan developed by Kanthimathi et al (Applied for Indian Patent, 2001) was added to the drum along with 26000 ml water. The drum was run for 8 hrs. Tanning was complete and the pH was found to be 4.0. Tanned leathers were post tanned to crust upholstery leathers using a standard recipe. Then the leathers were staked, trimmed and buffed.

The following are the advantages of the present invention:

1. This process hardly requires any complicated control measures.
2. The process ensures adequate and optimal fibre opening at pH in the range of 7.5–8.0.
3. It completely eliminates the formation of dry sludge.
4. Provides significant reduction in total solids and chemical oxygen demand.
5. The process leads to significant reduction in time, power and water.
6. Provides rationalization of fibre opening processes.
7. Suitable for all kinds of raw materials.
8. This process does not require a deliming step.
9. The product produces soft and supple leathers.
10. Cheaper and commercially available chemicals and enzymes are used for the process of the present invention.
11. This process hardly requires any complicated control measures.
12. The process avoids do-undo principles in leather processing.
13. It completely eliminates the formation of dry sludge.
14. Provides significant reduction in total solids and chemical oxygen demand.
15. The process leads to significant reduction in time, power and water.
16. Suitable for all kinds of raw materials and end products.
17. This process does not require deliming, pickling and basification steps.

We claim:

1. A leather processing technique comprising the steps of:

i) applying to raw skin or hide a dehairing paste comprising one or more enzymes either individually or in combination with a de-hairing enhancing compound;

ii) seasoning the skin or hide of step (i) for 8–20 hrs;

iii) de-hairing the seasoned skin or hide of step (ii);

iv) applying to the de-haired skin or hide of step (iii) one or more collagen fibre bundle opening enzymes or an alkali;

v) fleshing and washing the skin or hide of step (iv) to obtain clean pelt having cross section pH of from about 7.5 to about 8.5, and vi) tanning the pelt.

2. A process as claimed in claim 1, wherein the raw skin or hide used is selected from wet-salted, dry-salted, dried, green or freezed skin or hide.

3. A process as claimed in claim 1, wherein prior to applying the de-hairing paste, the skin or hide is soaked in water and drained from about 10 to about 20 minutes.

4. A process as claimed in claim 1, wherein the de-hairing paste consists of 10–20 wt. % of one or more enzymes, 0 to 15 wt. % of the de-hairing enhancing compounds and 70–90 wt. % of water.

5. A process as claimed in claim 1, wherein the de-hairing paste contains 0.5–2.0 wt. % of one or more enzymes on the soaked weight of skin or hide.

6. A process as claimed in claim 1, wherein the de-hairing paste contains 0–1.5 wt. % of the de-hairing enhancing compound on the soaked weight of skin or hide.

7. A process as claimed in claim 1, wherein the de-hairing paste contains 4–8 wt. % of water on the soaked weight of skin or hide.

8. A process as claimed in claim 1, wherein the enzyme is bacterial protease or fungal protease or combination thereof.

9. A process as claimed in claim 1, wherein the de-hairing enzyme is selected from bacterial alkaline protease, proteolytic enzyme or a combination thereof.

10. A process as claimed in claim 1, wherein the de-hairing enhancing compound is selected from sodium sulphide or sodium sulphydride.

11. A process as claimed in claim 1, wherein the de-hairing paste is applied on flesh or grain side of the skin or hide.

12. A process as claimed in claim 1, wherein the collagen fibre bundle opening enzyme is selected from the group comprising α-amylase, β-amylase, zymase, maltase, pectinase, elastase, hyaluronidase, α-galactosidase, or a combination thereof.

13. A process as claimed in claim 1, wherein the alkali used for opening fibre bundles is selected from the group comprising sodium hydroxide, potassium hydroxide or a combination thereof.

14. A process as claimed in claim 1, wherein 0.5–2.0 wt. % of collagen fibre bundle opening enzyme is used on the dehaired weight of skin or hide.

15. A process as claimed in claim 1, wherein 0.3 to 1.25 wt. % of alkali is used on the dehaired weight of skin or hide.

16. A process as claimed in claim 1, wherein 50 to 350 wt. % of water is used on the dehaired weight basis of skin or hide during collagen fibre bundle opening.

17. A process as claimed in claim 1, wherein the collagen fibre bundle opening is carried out for 2 to 24 hours.

18. A process as claimed in claim 1, wherein collagen fibre bundles of the skin or hide are opened by loading a drum with 50 to 350 wt. % water, 0.5 to 2.0 wt. % of the enzyme or 0.3 to 1.25 wt. % of the alkali and the hide or skin and running the drum from about 2 to about 24 hours.

19. A process as claimed in claim 1, wherein the pelt having cross section pH of 7.5 to 8.5 is pickled before the step of tanning.

20. A process as claimed in claim 1, wherein 4 to 10 wt. % of a tanning agent is added to fleshed skin or hide.

21. A process as claimed in claim 1, wherein 50 to 150 wt. % of water is added to fleshed skin during tanning.

22. A process as claimed in claim 1, wherein the tanning period is from about 2 to about 10 hours.

23. A process as claimed in claim 20, wherein the tanning agent is selected from polymeric syntan, basic chromium sulphate (BCS), chrome syntan, wattle extract, chromium-iron tanning agent, aluminium syntan, chromium-silica tanning, vegetable tanning agent or combination thereof.

* * * * *